US009787064B2

(12) United States Patent
Durham et al.

(10) Patent No.: US 9,787,064 B2
(45) Date of Patent: Oct. 10, 2017

(54) CORONA IGNITION WITH HERMETIC COMBUSTION SEAL

(71) Applicant: Federal-Mogul Ignition Company, Southfield, MI (US)

(72) Inventors: Patrick Durham, Troy, MI (US); James Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 657 days.

(21) Appl. No.: 14/269,448

(22) Filed: May 5, 2014

(65) Prior Publication Data

US 2014/0327999 A1 Nov. 6, 2014

Related U.S. Application Data

(60) Provisional application No. 61/819,098, filed on May 3, 2013.

(51) Int. Cl.

| | |
|---|---|
| ***F23Q 3/00*** | (2006.01) |
| ***H01T 19/04*** | (2006.01) |
| ***H01T 21/00*** | (2006.01) |
| ***H01T 13/36*** | (2006.01) |
| ***H01T 13/50*** | (2006.01) |
| ***H01T 21/02*** | (2006.01) |

(52) U.S. Cl.

CPC ..... *H01T 19/04* (2013.01); *H01T 13/36* (2013.01); *H01T 13/50* (2013.01); *H01T 21/00* (2013.01); *H01T 21/02* (2013.01); *Y10T 29/4902* (2015.01)

(58) Field of Classification Search

CPC ..... H01T 19/04; H01T 21/00

USPC ..... 361/230, 253

See application file for complete search history.

(56) References Cited

U.S. PATENT DOCUMENTS

| | | | |
|---|---|---|---|
| 1,230,797 | A | 6/1917 | Schmidt |
| 1,363,843 | A | 12/1920 | Crowther |
| 1,467,137 | A | 9/1923 | Curran |
| 1,471,283 | A | 10/1923 | Rogers |

(Continued)

FOREIGN PATENT DOCUMENTS

| | | | |
|---|---|---|---|
| FR | 2965984 A1 | | 4/2012 |
| FR | WO2012/049403 | * | 4/2012 |

OTHER PUBLICATIONS

International Search Report mailed Jul. 29, 2014 (PCT/US2014/036497).

*Primary Examiner* — Thienvu Tran
*Assistant Examiner* — Lucy Thomas
(74) *Attorney, Agent, or Firm* — Robert L. Stearns; Dickinson Wright, PLLC

(57) ABSTRACT

A corona igniter (20) comprises a central electrode (22) surrounded by an insulator (24), which is surrounded by a metal shell (26). A ceramic combustion seal (30) is disposed along the gap (32) between a shell lower end shell (52) and the insulator nose region (48) to provide a hermetic seal therebetween. The ceramic combustion seal (30) is typically a bushing, cylinder, or ring formed of sintered alumina. A glass material or glass/ceramic mixture (60) typically adheres the ceramic combustion seal (30) to the shell (26) and the insulator (24). Alternatively, the ceramic combustion seal (30) is brazed to the shell (26), and the glass material or glass/ceramic mixture (60) adheres the ceramic combustion seal (30) to the insulator (24).

19 Claims, 7 Drawing Sheets

(56) References Cited

U.S. PATENT DOCUMENTS

| | | | | |
|---|---|---|---|---|
| 2,657,248 | A | 10/1953 | Smits | |
| 2,684,665 | A | 7/1954 | Tognola | |
| 2,894,315 | A | 7/1955 | Candelise | |
| 2,760,099 | A | 8/1956 | Suter | |
| 3,883,762 | A | 5/1975 | Harris et al. | |
| 4,713,574 | A | 12/1987 | Scott | |
| 4,841,925 | A * | 6/1989 | Ward | F02P 3/0884 123/143 B |
| 5,128,583 | A | 7/1992 | Ma | |
| 5,885,928 | A * | 3/1999 | Hirano | B41M 5/38214 428/32.39 |
| 2008/0308057 | A1 * | 12/2008 | Lykowski | B23K 35/3066 123/169 EL |
| 2010/0175653 | A1 * | 7/2010 | Lykowski | H01T 13/04 123/143 C |
| 2012/0210968 | A1 | 8/2012 | Burrows | |
| 2013/0234581 | A1 | 9/2013 | Makarov et al. | |

* cited by examiner

CORONA IGNITION WITH HERMETIC COMBUSTION SEAL

CROSS-REFERENCE TO RELATED APPLICATIONS

This Utility Patent Application claims the benefit of U.S. Provisional Patent Application Ser. No. 61/819,098, filed May 3, 2013, the entire disclosure of the application being considered part of the disclosure of this application and hereby incorporated by reference.

BACKGROUND OF THE INVENTION

Field of the Invention

This invention relates generally to a corona igniter for emitting a radio frequency electric field to ionize a fuel-air mixture and provide a corona discharge, and a method of forming the igniter.

Related Art

Corona discharge ignition systems include an igniter with a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. Preferably, the electric field is controlled so that the fuel-air mixture does not lose all dielectric properties, which would create a thermal plasma and an electric arc between the electrode and grounded cylinder walls, piston, or other portion of the igniter. An example of a corona discharge ignition system is disclosed in U.S. Pat. No. 6,883,507 to Freen.

The corona igniter typically includes the central electrode formed of an electrically conductive material for receiving the high radio frequency voltage and emitting the radio frequency electric field to ionize the fuel-air mixture and provide the corona discharge. The electrode typically includes a high voltage corona-enhancing electrode tip emitting the electrical field. An insulator formed of an electrically insulating material is disposed around the central electrode. The igniter also includes a metal shell receiving the central electrode and the insulator. However, the igniter does not include any grounded electrode element intentionally placed in close proximity to a firing end of the central electrode. Rather, the ground is preferably provided by cylinder walls or a piston of the ignition system. An example of a corona igniter is disclosed in U.S. Patent Application Publication No. 2012/0210968 to Lykowski et al.

As shown in FIG. 1 of the '968 publication, a metal gasket provides a seal along the turnover region between the shell and insulator. However, over time, mechanical and thermal stresses wear on the gasket, such that the gasket cannot ensure a hermetic seal over the entire life of the igniter. In addition, the metal gasket does not prevent air from entering through the bottom opening of the shell and into the gap between the shell and insulator, which can lead to formation of corona discharge in the gap. A filler material, such as a resin, can be disposed between the shell and insulator to prevent corona discharge formation in the gap. However, the filler material is exposed to harsh conditions during operation of the engine and tends to degrade over time.

SUMMARY OF THE INVENTION

One aspect of the invention provides a corona igniter comprising a central electrode, an insulator, and a metal shell. The central electrode receives a high radio frequency voltage and emits a radio frequency electric field to ionize a fuel-air mixture and provide a corona discharge. The shell is formed of metal and surrounds the central electrode. The shell also extends longitudinally along a center axis from a shell upper end to a shell lower end. The insulator is disposed between the central electrode and the shell. The insulator also extends longitudinally along the center axis and includes an insulator nose region extending outwardly of the shell lower end. The insulator and the shell present a gap therebetween extending longitudinally along the center axis, and a ceramic combustion seal seals the gap between the shell and the insulator.

Another aspect of the invention provides a method of forming a corona igniter. The method includes providing a central electrode for receiving a radio frequency voltage and emitting a radio frequency electric field to ionize a fuel-air mixture and provide a corona discharge. The method then includes disposing the central electrode in a bore of an insulator, wherein the insulator extends longitudinally along a center axis and includes an insulator nose region. The method further includes surrounding the insulator with a shell formed of metal, wherein the shell extends longitudinally from a shell upper end to a shell lower end such that the insulator nose region extends outwardly of the shell lower end and the insulator and shell form a gap therebetween. The gap extends longitudinally along the center axis. The method next includes sealing the gap by disposing a ceramic combustion seal between the insulator and the shell.

The ceramic combustion seal protects the gap from the combustion gases and also protects any filler material that could be disposed in the gap. In addition, the ceramic combustion seal is durable, without creating significant mechanical or thermal stresses, and thus has the potential to perform well over the life of the corona igniter.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 5:
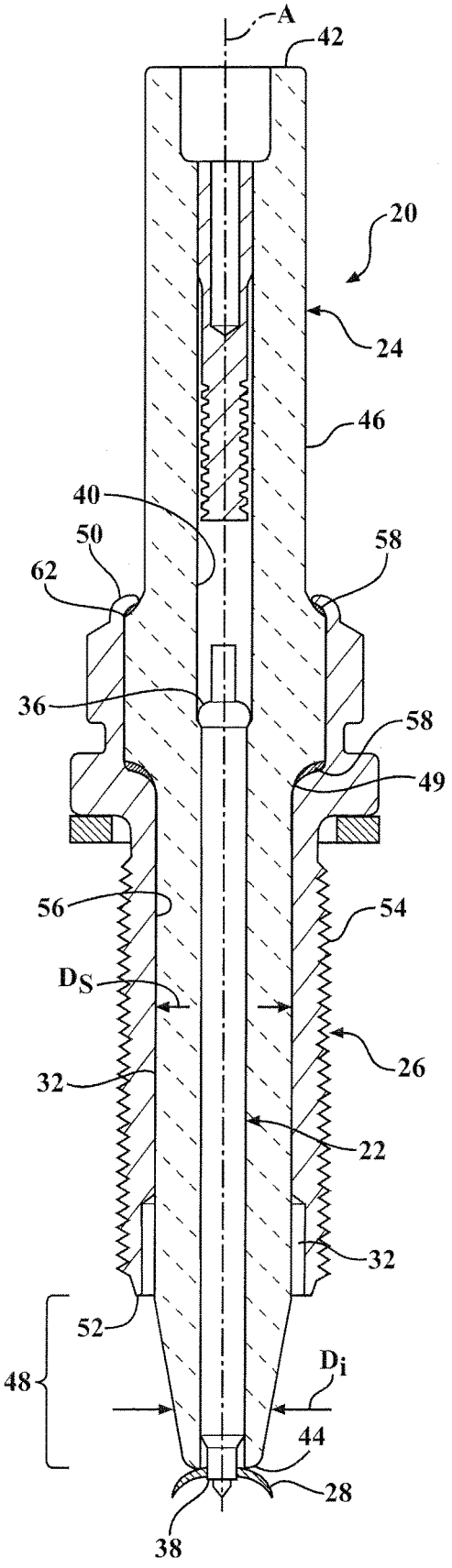
FIG. 5 is a cross-sectional view of a corona igniter according to another exemplary embodiment prior to attaching the ceramic combustion seal to the metal shell and insulator.
Figure 6:
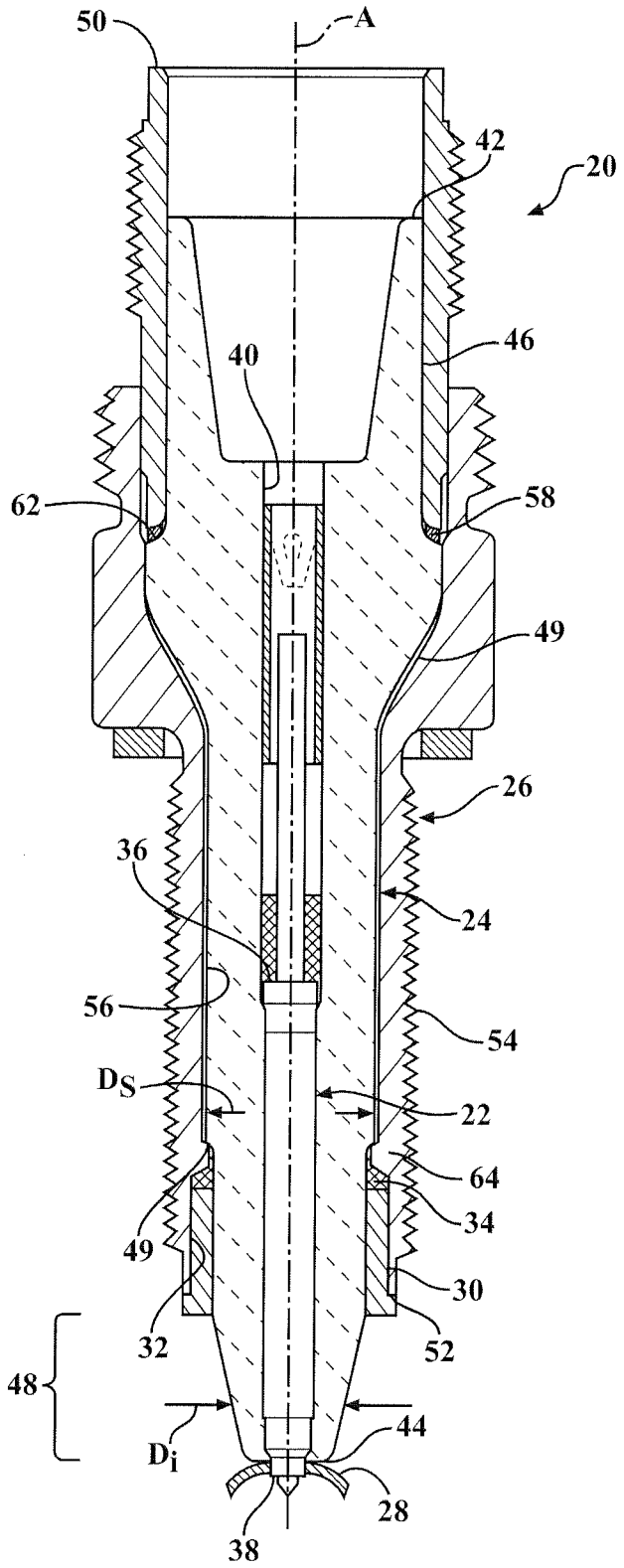
FIG. 6 is a cross-sectional view of a corona igniter according to yet another exemplary embodiment wherein the insulator design differs from the insulators shown in FIGS. 1-5 and the ceramic combustion seal is in the form of a bushing.
Figure 7:
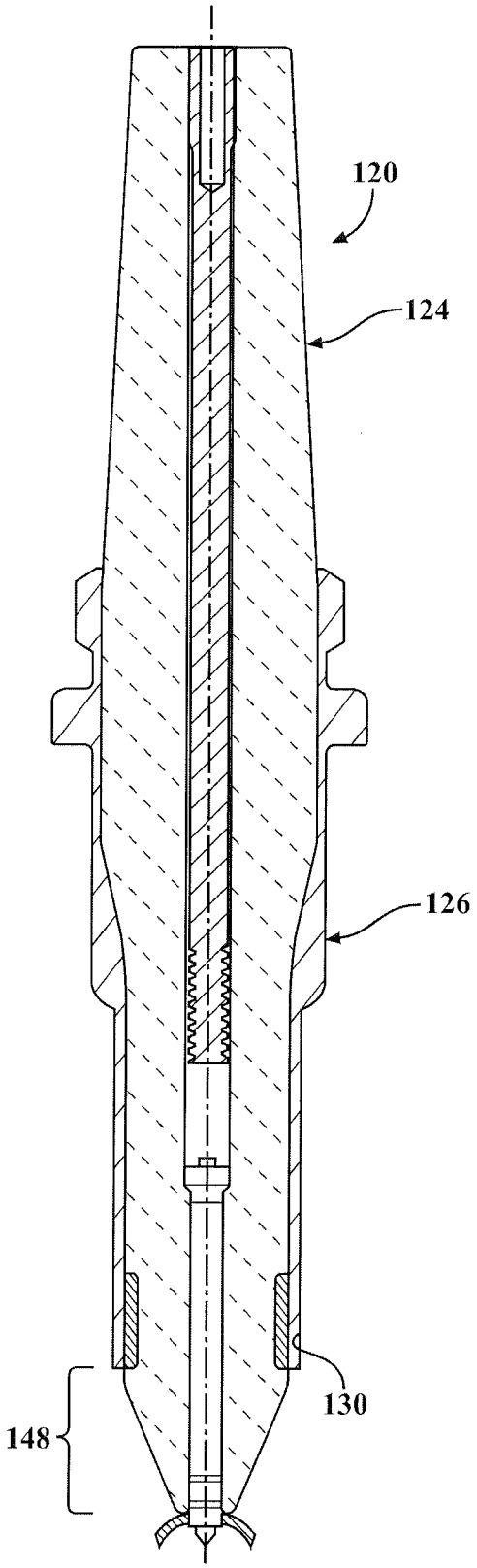
FIG. 7 is a cross-sectional view of a comparative corona igniter including a copper ring disposed in a groove of the insulator and brazed to the insulator and metal shell to seal the gap.

Exemplary embodiments of a corona igniter 20 according to the present invention are shown in FIGS. 1-6, and a comparative corona igniter is shown in FIG. 7. The corona igniter 20 includes a central electrode 22 for receiving a high radio frequency voltage, an insulator 24 surrounding the central electrode 22, and a metal shell 26 surrounding the insulator 24. The central electrode 22 includes a corona-enhancing tip 28 for emitting a radio frequency electric field to ionize a fuel-air mixture and provide a corona discharge. A ceramic combustion seal 30 attaches the insulator 24 to the metal shell 26 and hermetically seals a gap 32 between the insulator 24 and the metal shell 26. The ceramic combustion seal 30 prevents combustion gases from entering the gap 32, which could negatively affect the performance or service life of the corona igniter 20. The ceramic combustion seal 30 also protects any filler material 34 that could be disposed in the gap 32.

The central electrode 22 of the corona igniter 20 is formed of an electrically conductive material for receiving the high radio frequency voltage, typically in the range of 20 to 75 KV peak/peak. The central electrode 22 also emits a high radio frequency electric field, typically in the range of 0.9 to 1.1 MHz. The central electrode 22 extends longitudinally along a center axis A from a terminal end 36 to an electrode firing end 38. The central electrode 22 typically includes the corona enhancing tip 28 at the electrode firing end 38, for example a tip 28 including a plurality of prongs, as shown in FIGS. 1-6.

The insulator 24 of the corona igniter 20 is formed of an electrically insulating material, such as alumina. The insulator 24 includes an insulator inner surface 40 which surrounds a bore and receives the central electrode 22 and extends longitudinally along the center axis A from an insulator upper end 42 to an insulator nose end 44. A seal is typically used to secure the central electrode 22 and an electrical contact in the bore of the insulator 24. The insulator 24 also includes an insulator outer surface 46 presenting an insulator outer diameter $D_i$ and extending from the insulator upper end 42 to the insulator nose end 44. As shown in FIGS. 1-6, the insulator 24 includes an insulator nose region 48, and the insulator outer diameter $D_i$ along the insulator nose region 48 tapers toward the insulator nose end 44. The electrode firing end 38 is typically disposed outwardly of the insulator nose end 44. In the embodiments of FIGS. 1-6, the insulator outer surface 46 does not include a groove as a stress riser for retaining the ceramic combustion seal 30, like the insulator of the comparative igniter shown in FIG. 7.

Figure 4:
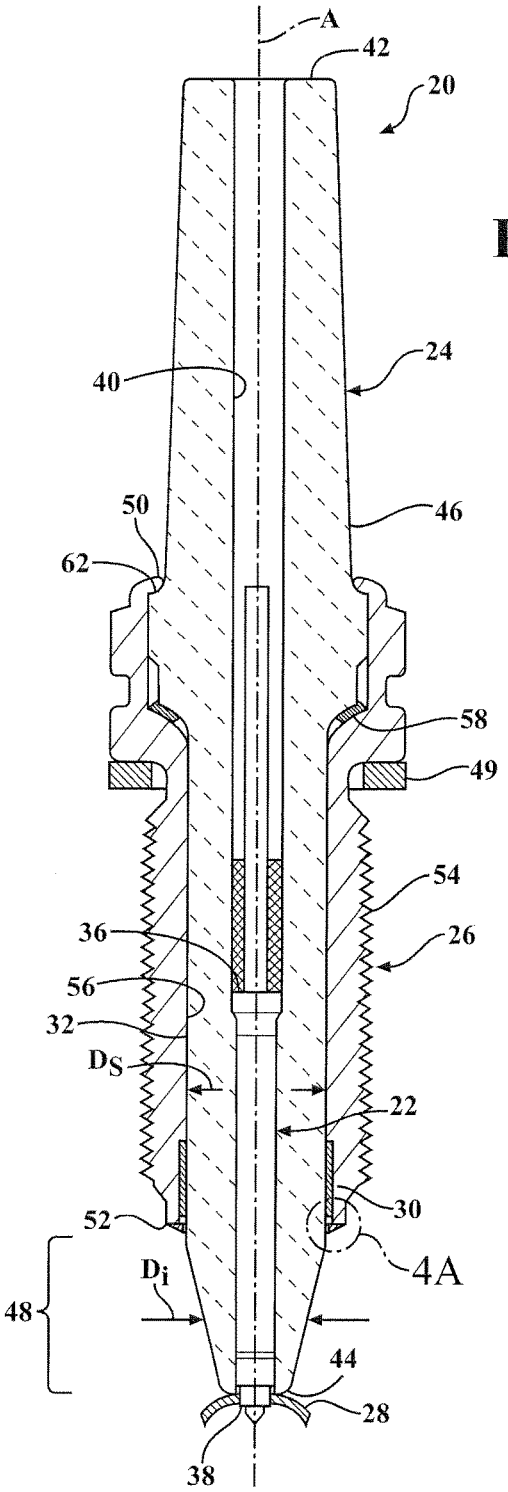
FIG. 4 is a cross-sectional view of a corona igniter according to another exemplary embodiment wherein the ceramic combustion seal is disposed along the shell lower end.

In the exemplary embodiments of FIGS. 1-6, the insulator outer diameter $D_i$ decreases along a portion of the insulator 24 moving toward the insulator nose end 44 to present an insulator lower shoulder 49 and also decreases along a portion of the insulator 24 moving toward the insulator upper end 42 at a location spaced from the insulator lower shoulder 49 to present an insulator upper shoulder 62. In the embodiments of FIGS. 1-5, the insulator outer diameter $D_i$ is constant along a portion of the insulator 24 between the insulator lower shoulder 49. However, the insulator outer diameter $D_i$ could alternatively vary along a portion of the insulator 24 between the insulator lower shoulder 49 and the insulator nose region 48. In the embodiment of FIG. 6, the insulator outer diameter $D_i$ decreases moving toward the insulator nose region 48 to present a second insulator lower shoulder 49. The insulator outer diameter $D_i$ between the insulator lower shoulder 49 and the insulator nose end 44 is typically less than the insulator outer diameter $D_i$ between the insulator lower shoulder 49 and the insulator upper shoulder 62. The insulator outer diameter $D_i$ typically tapers along the insulator nose region 48 to the insulator nose end 44.

The shell 26 is formed of a metal material, such as steel, and surrounds at least a portion of the insulator 24. The shell 26 extends along the center axis A from a shell upper end 50 to a shell lower end 52. The shell 26 presents a shell outer surface 54 and a shell inner surface 56. The shell inner surface 56 faces the center axis A and extends along the insulator outer surface 46 from the shell upper end 50 to the shell lower end 52. The shell inner surface 56 presents a bore surrounding the center axis A and a shell inner diameter $D_s$ extending across and perpendicular to the center axis A. The inner surface 56 can also present shoulders for engaging the shoulders 49, 62 of the insulator 24. In the embodiment of FIG. 6, the shell 26 includes an inner rib 64 for engaging the lowest of the two insulator lower shoulders 49. The shell inner diameter $D_s$ is typically greater than or equal to the insulator outer diameter $D_i$ along the entire length of the insulator 24 from the insulator upper end 42 to the insulator nose end 44, so that the corona igniter 20 can be forward-assembled. The term "forward-assembled" means that the insulator nose end 44 can be inserted into the shell bore through the shell upper end 50, rather than through the shell lower end 52. However, in an alternate embodiment, the shell inner diameter $D_s$ is less than or equal to the insulator outer diameter $D_i$ along a portion of the length of the insulator 24, and the corona igniter 20 is reversed-assembled. The term "reverse-assembled" means that the insulator upper end 42 is inserted into the shell bore through the shell lower end 52. The embodiments of FIGS. 1-6 show forward-assembled corona igniters 20, wherein the insulator nose region 48 extends outwardly of the shell lower end 52, but the present invention could be used with reverse-assembled corona igniters, or igniters having other designs. In these exemplary embodiments of FIG. 1-5, the shell 26 is formed around the shoulders 49, 62 of the insulator 24, and the shell upper end 50 rests on the insulator upper shoulder 62. In the embodiment of FIG. 6, the shell upper end 50 extends longitudinally past the insulator upper end 42.

Figure 1:
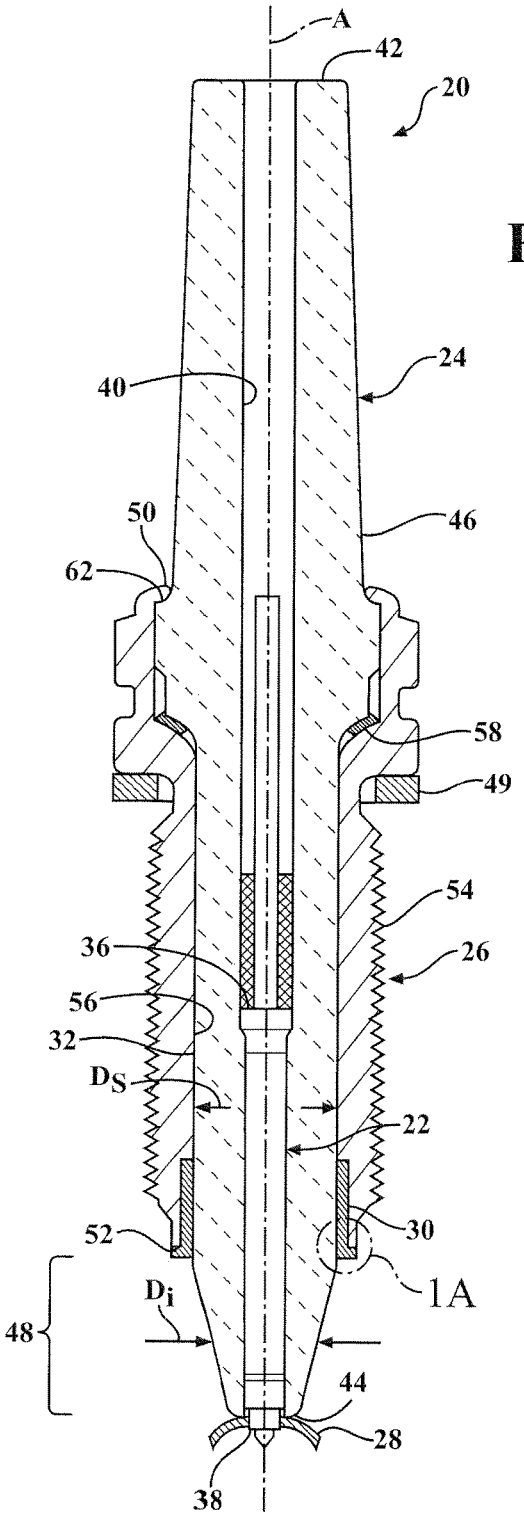
FIG. 1 is a cross-sectional view of a corona igniter according to one exemplary embodiment which includes a ceramic combustion seal in the form of a bushing.
Figure 2:
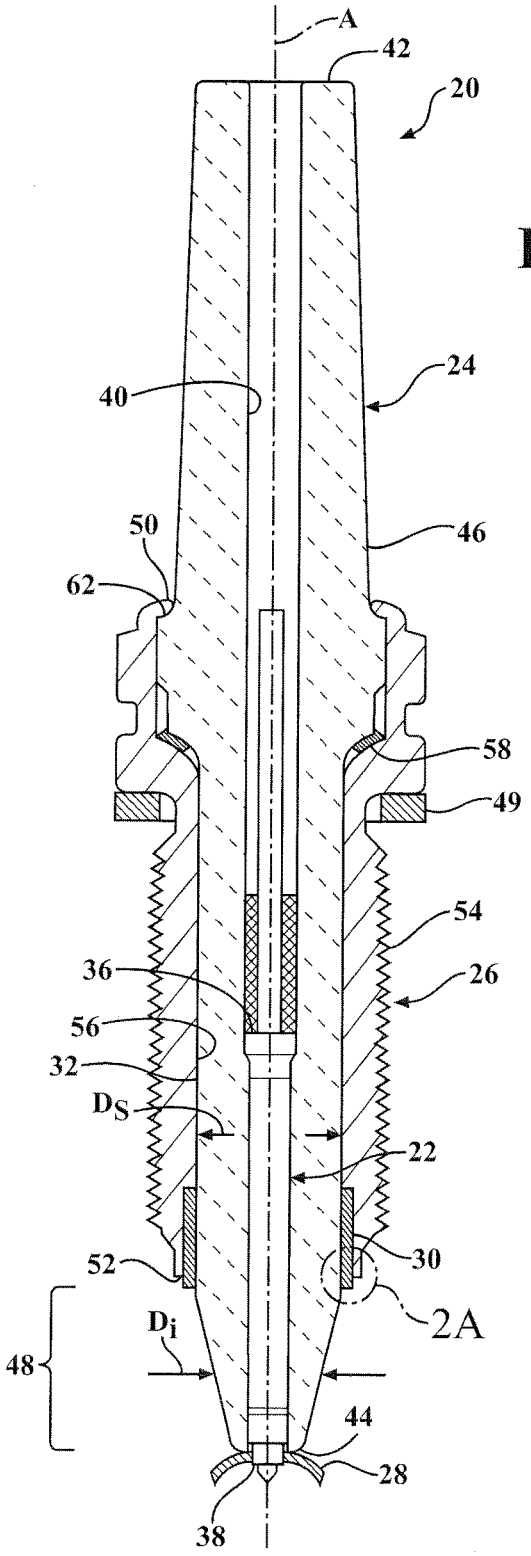
FIG. 2 is a cross-sectional view of a corona igniter according to another exemplary embodiment wherein the ceramic combustion seal is in the form of a cylinder.

The gap 32 between the insulator 24 and shell 26 typically extends longitudinally along the center axis A from the shell lower end 52 to the insulator lower shoulder 49 adjacent the turnover region of the igniter 20. The gap 32 also extends radially outward relative to the center axis A from the insulator outer surface 46 to the shell inner surface 56. In the embodiments of FIGS. 1 and 2, the shell inner diameter $D_s$ increases adjacent the shell lower end 52 to increase a portion of the gap 32, and the increased portion of the gap 32 retains the ceramic combustion seal 30.

A conformal element 58, such as a soft metal gasket formed of copper or annealed steel, or a plastic or rubber material, can be compressed between the metal shell 26 and insulator 24 to provide stability to the corona igniter 20. The conformal element 58 is disposed in the gap 32 at a location spaced longitudinally from the ceramic combustion seal 30. Thus, the conformal element 58 provides another seal between the insulator 24 and shell 26 and terminates the end of the gap 32. FIGS. 1-6 show the conformal element 58 in the form of a gasket disposed between a shoulder 49, 62 of the insulator 24 and a shoulder of the metal shell 26. In FIGS. 1-5, the gasket is disposed between the insulator lower shoulder 49 and the metal shell 26. FIG. 5 also shows a second gasket disposed between the insulator upper shoulder 62 and the shell upper end 50. In FIG. 6, the gasket is only disposed between the insulator upper shoulder 62 and the metal shell 26.

Once the insulator 24 is disposed in the metal shell 26, the gap 32 remains between the insulator outer surface 46 and the shell inner surface 56. The gap 32 is undesirable because air and other gases from the combustion chamber enter the gap 32 during engine operation. Corona discharge can form in the gap 32, which reduces the strength of the corona discharge at the electrode firing end 38. Oftentimes a filler material 34 is disposed in the gap 32, as shown in FIGS. 3A and 4A, to prevent corona discharge formation, but the filler material 34 can degrade over time as it is exposed to the combustion gases.

As shown in FIGS. 1-6, the ceramic combustion seal 30 is disposed along the gap 32 between the shell 26 and insulator 24 to prevent air from entering the gap 32, or to protect the filler material 34 from the combustion gases. The ceramic combustion seal 30 extends continuously from the metal shell 26 to the insulator outer surface 46 and thus provides a hermetic seal between the insulator 24 and shell 26. As shown in FIGS. 1-6, the ceramic combustion seal 30 preferably extends from the shell lower end 52, or the shell inner surface 56 adjacent the shell lower end 52, to the insulator outer surface 46 adjacent the insulator nose region 48. The ceramic combustion seal 30 is provided as a sintered ceramic material, such as alumina. The ceramic combustion seal can be formed of sintered ceramic material which is the same as or different from the material of the insulator. The ceramic combustion seal 30 is also preferably a durable component, such as a solid bushing, cylinder, or ring, but can have a variety of different shapes. The outer surfaces of the ceramic combustion seal 30 which engage the shell 26 and insulator 24 are typically flat and engage the flat surfaces 46, 52, 56 of the insulator 24 and/or shell 26.

Figure 1A:
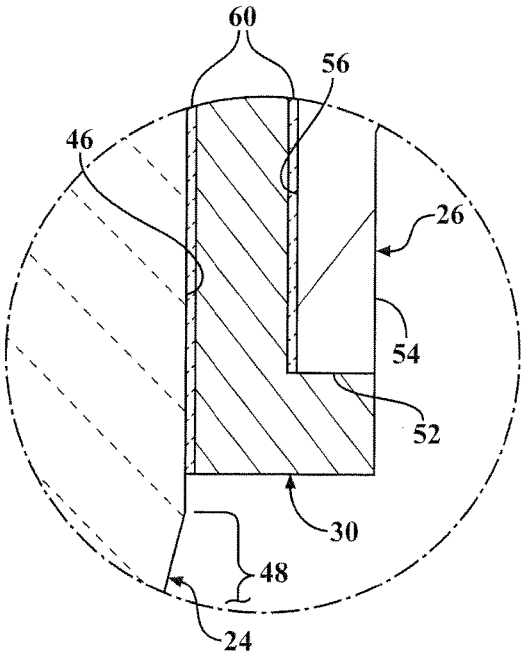
FIG. 1A is an enlarged view of a portion of FIG. 1, showing the ceramic combustion seal between the insulator and shell.
Figure 2A:
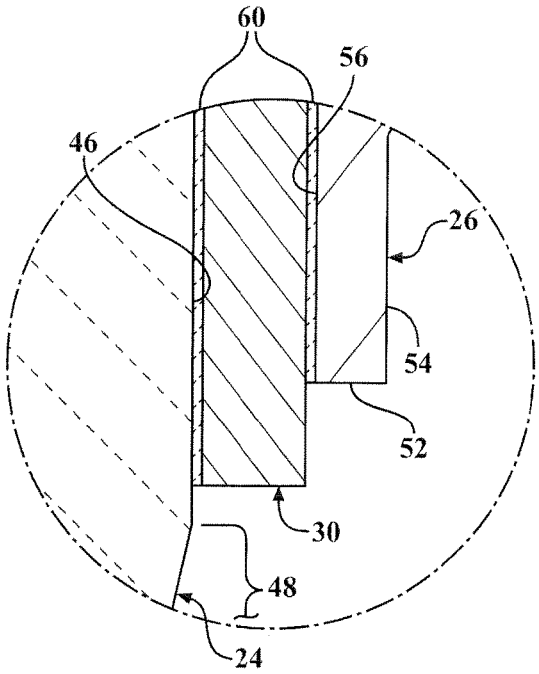
FIG. 2A is an enlarged view of a portion of FIG. 2, showing the ceramic combustion seal between the insulator and shell.

The ceramic combustion seal 30 is first disposed along the gap 32, and then attached to the insulator 24 and the shell 26. A glass material or glass/ceramic mixture 60 is typically used to adhere the ceramic combustion seal 30 to the insulator 24 and the shell 26, as shown in FIGS. 1A and 2A. The glass material consists essentially of glass, and the glass/ceramic mixture includes a mixture of glass and ceramic in any proportion. However, in another embodiment, the ceramic combustion seal 30 is brazed to the metal shell 26, but still attached to the insulator 24 using the glass material or glass/ceramic mixture 60, as shown in FIGS. 3A and 4A.

In the embodiment of FIGS. 1 and 1A, the ceramic combustion seal 30 is a bushing disposed in the gap 32 between the insulator 24 and the shell 26. The shell inner diameter $D_s$ increases adjacent the shell lower end 52 such that the shell inner surface 56 presents a groove for receiving the bushing. The bushing includes a cylindrical portion disposed along the section of the shell inner surface 56 with the increased shell inner diameter $D_s$. The bushing also includes a flange extending outwardly from the cylinder and along the shell lower end 52 to the shell outer surface 54. The cylinder and flange of the bushing also extends along the insulator outer surface 46 directly adjacent the insulator nose region 48.

In the embodiment of FIGS. 2 and 2A, the ceramic combustion seal 30 is a cylinder disposed in the gap 32. The shell inner surface 56 again presents the increased shell inner diameter $D_s$, and the cylinder is disposed along the increased shell inner diameter $D_s$. The cylinder extends along the shell inner surface 56 and slightly past the shell lower end 52, but does not extend along the shell lower end 52. The cylinder also extends along the insulator outer surface 46 directly adjacent the insulator nose region 48.

Figure 3:
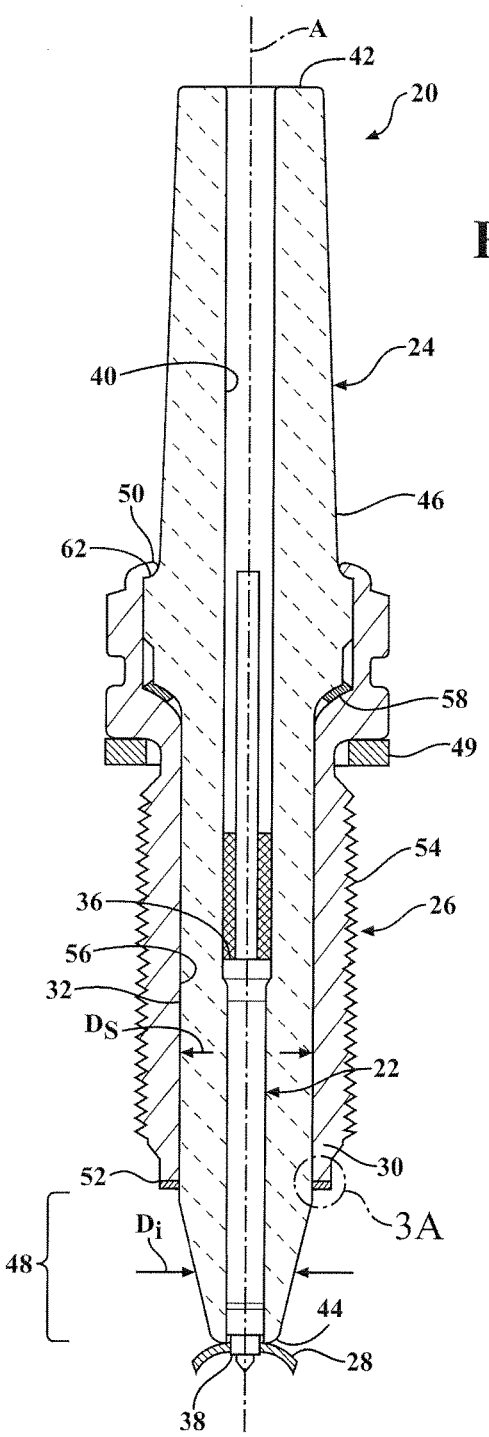
FIG. 3 is a cross-sectional view of a corona igniter according to another exemplary embodiment wherein the ceramic combustion seal is in the form of a ring.
Figure 3A:
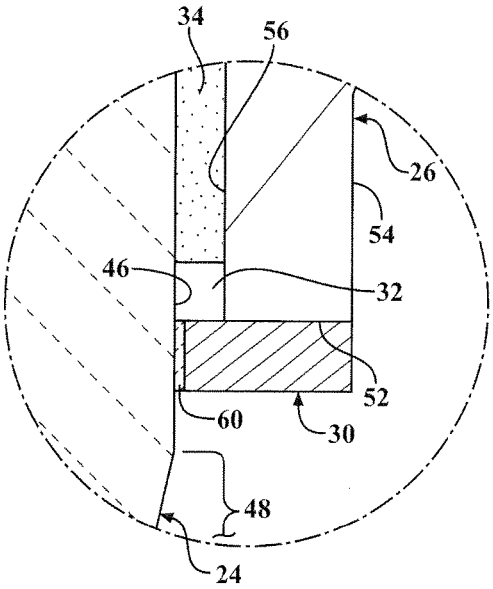
FIG. 3A is an enlarged view of a portion of FIG. 3, showing the ceramic combustion seal between the insulator and shell.

In the embodiment of FIGS. 3 and 3A, the ceramic combustion seal 30 is a ring disposed along the gap 32. The ring has a rectangular cross-section. In this embodiment, the shell inner surface 56 does not present the groove. Instead, the ring extends along the shell lower end 52 from the shell outer surface 54 to the insulator outer surface 46 adjacent the insulator nose region 48. Also in the embodiment of FIGS. 3 and 3A, a filler material 34 is disposed in the gap 32 between the insulator 24 and the shell 26.

Figure 4A:
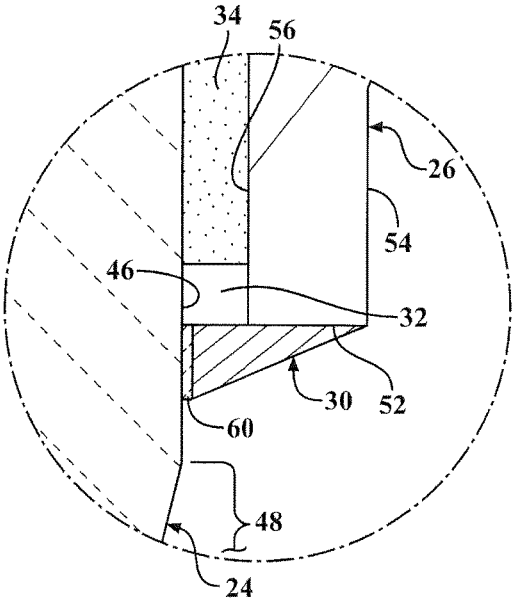
FIG. 4A is an enlarged view of a portion of FIG. 4, showing the ceramic combustion seal between the insulator and shell.

In the embodiment of FIGS. 4 and 4A, the ceramic combustion seal 30 again extends along the shell lower end 52 from the shell outer surface 54 to the insulator outer surface 46, and a filler material 34 is disposed in the gap 32 between the insulator 24 and the shell 26. However, in this embodiment, the ceramic combustion seal 30 has a triangular cross-section.

Another aspect of the invention provides a method of forming the corona igniter 20. The method includes disposing the central electrode 22 in the insulator 24, and disposing the insulator 24 in the metal shell 26, using either the forward-assembly or reverse-assembly process. The method further includes providing the ceramic combustion seal 30, which is a sintered ceramic material, such as alumina. The ceramic combustion seal 30 is preferably a bushing, cylinder, or ring, but can have a variety of different shapes. FIG. 5 shows the corona igniter 20 prior to attaching the ceramic combustion seal 30 to the insulator 24 and shell 26.

The method next includes disposing the ceramic combustion seal 30 along the gap 32 and attaching the ceramic combustion seal 30 to the insulator 24 and the shell 26 to provide a hermetic seal between the insulator 24 and shell 26. The attaching step typically includes adhering the ceramic combustion seal 30 to the insulator 24 and the shell 26 with a glass material or glass/ceramic mixture 60. In another embodiment, the method includes brazing the ceramic combustion seal 30 to the metal shell 26, and adhering the ceramic combustion seal 30 to the insulator 24 with the glass material or glass/ceramic mixture 60.

FIG. 7 shows a comparative corona igniter 120 with a copper ring 130 disposed in a groove of the insulator 124 adjacent the insulator nose region 148 to provide a seal between the insulator 124 and shell 126. However, the groove in the insulator 124 creates a large stress concentration, which could cause the insulator 124 to crack over time. A solid glass filler has also been used to seal the gap between the insulator and shell of an igniter, but the solid glass filler tends to erode over time due to exposure to the combustion gases.

The corona igniter 20 with the ceramic combustion seal 30 of the present invention is expected to perform better over the life of the corona igniter 20, compared to igniters with other components used to seal the gap between the insulator and shell. The ceramic combustion seal 30 is durable, without creating significant mechanical or thermal stresses, and thus has the potential to perform well over the life of the corona igniter 20.

Obviously, many modifications and variations of the present invention are possible in light of the above teachings and may be practiced otherwise than as specifically described while within the scope of the claims.

What is claimed is:

1. A corona igniter, comprising:

a central electrode for receiving a radio frequency voltage and emitting a radio frequency electric field to ionize a fuel-air mixture and provide a corona discharge;

a shell formed of metal surrounding said central electrode and extending longitudinally along a center axis from a shell upper end to a shell lower end;

said shell including a shell inner surface facing said insulator and presenting a shell inner diameter extending across and perpendicular to said center axis, said shell inner diameter increasing adjacent said shell lower end;

an insulator disposed between said central electrode and said shell;

said insulator extending longitudinally along said center axis and including an insulator nose region extending outwardly of said shell lower end;

said insulator and said shell presenting a gap therebetween, said gap extending longitudinally along said center axis; and a ceramic combustion seal sealing said gap between said shell and said insulator, wherein said ceramic combustion seal is disposed in said gap along said increased shell inner diameter adjacent said shell lower end.

2. The corona igniter of claim 1, wherein said ceramic combustion seal is formed of sintered ceramic material.

3. The corona igniter of claim 2, wherein said sintered ceramic material of said ceramic combustion seal includes alumina.

4. The corona igniter of claim 1, wherein said ceramic combustion seal extends continuously from said shell lower end and/or a shell inner surface adjacent said shell lower end across said gap to said insulator; and said ceramic combustion seal hermetically seals said gap.

5. The corona igniter of claim 1, wherein said ceramic combustion seal includes a cylinder disposed in said gap along said increased shell inner diameter.

6. The corona igniter of claim 5, wherein said ceramic combustion seal is a bushing including said cylinder disposed in said gap along said increased shell inner diameter; and said bushing includes a flange extending outwardly from said cylinder along said shell lower end.

7. The corona igniter of claim 1, wherein said ceramic combustion seal comprises a ring disposed along said shell lower end.

8. The corona igniter of claim 1, wherein a glass material or a mixture of glass and ceramic adheres said ceramic combustion seal to at least one of said insulator and said shell.

9. The corona igniter of claim 1, wherein said ceramic combustion seal is brazed to said shell.

10. The corona igniter of claim 1, wherein said insulator presents an insulator outer surface having an insulator outer diameter extending across and perpendicular to said center axis;

said insulator outer surface extends longitudinally from an insulator upper end to an insulator nose end;

said insulator outer diameter decreases along a portion of said insulator moving toward said insulator nose end to present an insulator lower shoulder;

said insulator outer diameter decreases along a portion of said insulator moving toward said insulator upper end at a location spaced from said insulator lower shoulder to present an insulator upper shoulder;

said insulator outer diameter tapers along said insulator nose region to said insulator nose end;

said insulator outer diameter between said insulator lower shoulder and said insulator nose end is less than said insulator outer diameter between said insulator lower shoulder and said insulator upper shoulder;

said shell upper end is disposed on said insulator upper shoulder; and said ceramic combustion seal is disposed along said portion of said insulator outer surface between said insulator lower shoulder and said insulator nose region.

11. The corona igniter of claim 1 including at least one conformal element disposed in said gap and compressed between said insulator and said shell; and said conformal element is spaced longitudinally from said ceramic combustion seal.

12. The corona igniter of claim 1 including a filler material filling at least a portion of said gap between said insulator and said shell.

13. The corona igniter of claim 1, wherein said central electrode is disposed on and extends longitudinally along said center axis from a terminal end to a firing end;

said firing end of said central electrode includes a corona enhancing tip disposed axially outwardly of said insulator nose region and has a plurality of prongs each extending radially outwardly from said center axis;

said insulator extends longitudinally from an insulator upper end to an insulator nose end, wherein said insulator nose region is adjacent said insulator nose end;

said insulator presents an insulator inner surface surrounding a bore receiving said central electrode and extending longitudinally from said insulator upper end to said insulator nose end;

said insulator presents an insulator outer surface having an insulator outer diameter extending across and perpendicular to said center axis;

said insulator outer surface extends longitudinally from said insulator upper end to said insulator nose end;

said insulator outer diameter decreases along a portion of said insulator moving toward said insulator nose end to present an insulator lower shoulder;

said insulator outer diameter decreases along a portion of said insulator moving toward said insulator upper end at a location spaced from said insulator lower shoulder to present an insulator upper shoulder;

said insulator outer diameter tapers along said insulator nose region to said insulator nose end;

said insulator outer diameter between said insulator lower shoulder and said insulator nose end is less than said insulator outer diameter between said insulator lower shoulder and said insulator upper shoulder;

said insulator upper shoulder engages said shell upper end;

said insulator is formed of alumina;

said shell inner surface surrounds said insulator outer surface and a shell outer surface facing away from said insulator outer surface;

said shell inner surface and said shell outer surface extend longitudinally along said center axis from said shell upper end to said shell lower end;

said shell inner surface presents a bore receiving said insulator;

said shell inner diameter is greater than said insulator outer diameter along the length of said shell;

said gap between said insulator and said shell extends radially relative to said center axis from said insulator outer surface to said shell inner surface;

said gap between said insulator and said shell extends longitudinally along said center axis from said insulator lower shoulder to said shell lower end;

at least one conformal element is disposed in said gap and compressed between said insulator outer surface and said shell inner surface and is spaced longitudinally from said ceramic combustion seal;

said at least one conformal element seals said gap at a location spaced longitudinally from said ceramic combustion seal;

one of said at least one conformal element is disposed between said insulator lower shoulder and said shell inner surface;

one of said at least one conformal element is a gasket formed of metal, a rubber material, or a plastic material;

a filler material is disposed in said gap between said ceramic combustion seal and said conformal element;

said ceramic combustion seal extends continuously from said shell lower end and/or said shell inner surface adjacent said shell lower end across said gap to said insulator outer surface and hermetically seals said gap;

said ceramic combustion seal is formed of sintered ceramic material;

said sintered ceramic material of said ceramic combustion seal includes alumina;

said ceramic combustion seal is provided as a bushing, a cylinder, or a ring; and a glass material and/or a mixture of glass and ceramic adheres said ceramic combustion seal to at least one of said insulator outer surface and said shell inner surface.

14. The corona igniter of claim 13, wherein said ceramic combustion seal comprises a cylinder, a bushing, or a ring disposed along or adjacent said lower shell end.

15. The corona igniter of claim 13, wherein one of said at least one conformal element is compressed between said insulator upper shoulder and said shell inner surface.

16. A method of forming a corona igniter, comprising the steps of:

providing a central electrode for receiving a radio frequency voltage and emitting a radio frequency electric field to ionize a fuel-air mixture and provide a corona discharge;

disposing the central electrode in a bore of an insulator, wherein the insulator extends longitudinally along a center axis and includes an insulator nose region;

surrounding the insulator with a shell formed of metal and extending longitudinally from a shell upper end to a shell lower end such that the insulator nose region extends outwardly of the shell lower end and the insulator and shell form a gap therebetween, wherein the gap extends longitudinally along the center axis, the shell including a shell inner surface facing the insulator and presenting a shell inner diameter extending across and perpendicular to the center axis, and the shell inner diameter increasing adjacent the shell lower end; and sealing the gap by disposing a ceramic combustion seal between the insulator and the shell, wherein said ceramic combustion seal is disposed in said gap along said increased shell inner diameter adjacent said shell lower end.

17. The method of claim 16 including inserting the insulator nose region into a bore of the shell through the shell upper end.

18. The method of claim 16, wherein the sealing step includes adhering the ceramic combustion seal to at least one of the insulator and the shell with a glass material and/or a mixture of glass and ceramic.

19. The method of claim 16, wherein the sealing step includes brazing the ceramic combustion seal to the shell.

* * * * *